US006158815A

United States Patent [19]

Sugie et al.

[11] Patent Number: 6,158,815

[45] Date of Patent: Dec. 12, 2000

[54] SEAT HAVING A SEAT CUSHION INCLUDING A POLYURETHANE FOAM PAD ONTO A PORTION OF WHICH A STRETCHABLE, NONWOVEN FABRIC IS LAMINATED

[75] Inventors: Takanori Sugie; Masanobu Banno, both of Osaka, Japan

[73] Assignee: Toyo Tire & Rubber Co., Ltd., Osaka, Japan

[21] Appl. No.: 09/220,714

[22] Filed: Dec. 24, 1998

[51] Int. Cl.[7] ..... A47C 7/02

[52] U.S. Cl. ..... 297/452.61; 297/452.49

[58] Field of Search ..... 297/452.49, DIG. 2, 297/DIG. 1, 452.61, 452.58

[56] References Cited

U.S. PATENT DOCUMENTS

| | | |
|---|---|---|
| 3,189,386 | 6/1965 | Gescheidle . |
| 4,579,388 | 4/1986 | Urai . |
| 4,627,664 | 12/1986 | Okazaki et al. . |
| 4,699,427 | 10/1987 | Kobayashi . |
| 4,747,638 | 5/1988 | Saito . |
| 4,784,437 | 11/1988 | Shimada . |
| 4,813,738 | 3/1989 | Ito . |
| 4,840,430 | 6/1989 | Shimada . |
| 4,865,379 | 9/1989 | Aoki et al. . |
| 4,867,508 | 9/1989 | Urai . |
| 4,883,318 | 11/1989 | Adachi . |
| 5,000,515 | 3/1991 | Deview . |
| 5,058,955 | 10/1991 | Sugiura et al. . |
| 5,176,424 | 1/1993 | Tobita et al. . |
| 5,248,185 | 9/1993 | Weingartner et al. . |
| 5,405,178 | 4/1995 | Weingartner et al. . |
| 5,544,942 | 8/1996 | Vu Khac et al. . |

*Primary Examiner*—Milton Nelson, Jr.
*Attorney, Agent, or Firm*—Jordan and Hamburg LLP

[57] ABSTRACT

A seat includes a seat frame having a steel spring, and a cushion pad of soft polyurethane molded foam placed on the steel spring. A stretchable nonwoven fabric, having an elongation after fracture of at least 180%, is integrally formed in a laminated manner at a portion of the cushion pad in contact with the steel spring thereby providing enhanced comfort while inhibiting wear or breakage of the cushion pad due to the steel spring acting thereupon.

14 Claims, 6 Drawing Sheets

SEAT HAVING A SEAT CUSHION INCLUDING A POLYURETHANE FOAM PAD ONTO A PORTION OF WHICH A STRETCHABLE, NONWOVEN FABRIC IS LAMINATED

BACKGROUND OF THE INVENTION

The present invention relates to a seat cushion to be suitably used in the field of a car seat or a furniture chair.

Conventionally, the car seat or furniture seat is desirably manufactured by placing a cushion pad of soft polyurethane mold foam directly on a steel spring and by covering the cushion pad with a surface material. In this case, the portion of the cushion pad to contact with the steel spring is liable to wear and break. In order to eliminate this defect, therefore, a reinforcing spring pad is integrally laminated on the portion of the cushion pad with which portion the steel spring is in contact.

As this spring pad, coarse blanket has been generally used in conventional art. Because this coarse blanket is made of a nonwoven fabric of short fibers impregnated with a small amount of resin, the spring pad lacks stretchability and elasticity. Therefore, when the load of a human body is applied onto the seat cushion having the coarse blanket as the spring pad, the coarse blanket molded integrally with the cushion pad is not deformed while the cushion pad and the steel spring are deformed, so that the seat cushion causes uncomfortable and nerves-jarring feeling to the human body.

Especially, by the recent development of the automobile industry, the cushion pad is made thinner and thinner by the restrictions on the seat designs so that it is hard to establish a "stroke feel" or a feel that the seat sinks deeply but does not touch the bottom. Thus, it has been desired to improve the seating comfort.

In view of such circumstances, the invention is aimed to improve comfort of a seat cushion, which is made by placing a cushion pad of soft polyurethane molded foam on a steel spring, by eliminating the uncomfortable and nerves-jarring sense while preventing the wear or breakage of the cushion pad due to the steel spring.

SUMMARY OF THE INVENTION

According to the invention, there is provided a seat cushion comprising: a seat frame including steel spring; and a cushion pad of soft polyurethane molded foam placed on the steel spring, wherein the improvement comprises a stretchable nonwoven fabric which is integrally formed in laminated manner at the portion of the cushion pad to contact with the steel spring.

The seat cushion of the invention is constructed by using the stretchable nonwoven fabric at the contacting portion of the cushion pad with the steel spring, so that the cushion pad is prevented from being worn or broken by the steel spring. When a load is applied from a seated human body, on the other hand, a free extension or shrinkage approximate to the deformation of the steel spring itself can be effected, to improve the spring characteristics of the seat cushion. Even with the density or hardness of the cushion pad being identical to those of the prior art, more specifically, it is possible to establish the stroke feel or the feel that the seat sinks deeply but does not touch the bottom. Due to an increase of rebound ratio, on the other hand, "rebound feel" or the feel that the hip or hand rebounds moderately or comfortably is improved. This makes it possible to provide a satisfactory comfort at seating, with neither the uncomfortable sense nor nerves-jarring sense.

It is essential for the stretchable unwoven fabric not to deteriorate the deformation performance of the cushion pad when the stretchable unwoven fabric is formed integrally with the cushion pad in laminated manner. It is therefore desired to select and use an unwoven fabric which is made of elastic fibers of a polyurethane or polystyrene thermoplastic elastomer by the spun bonding method or melt blowing method and which exhibits a high elongation and a high recovery ratio as high as those of the cushion pad. Specifically, the desired stretchable nonwoven fabric is composed of elastic fibers having an after-fracture elongation of 180% or more.

The stretchable nonwoven fabric having such characteristics can be suitably exemplified by a spun bond nonwoven fabric (commercially available under the trade name of "Espansione" from Kanebo Co., Ltd.) made from a thermoplastic polyurethane elastomer, or a melt blow unwoven fabric (commercially available under the trade name of "Septon MB" from Kuraray Co., Ltd.) made from a block copolymer having styrene phase and hydrogenated polyisoprene phase.

The seat cushion is preferred to have a logarithmic decrement of 0.69 or less for a free oscillation so as to achieve a satisfactory rebound feel as the seat.

In the invention, the free oscillation is the oscillation of a pressure plate of 50 kg in JM type when the pressure plate has made a free fall onto a predetermined load position on the seat surface, in a damping test prescribed in JASO B 407.

The "JASO B 407" is a cushion testing method of a car seat of Japanese Automobile Standard Organization. In this damping test, a pressure plate having a predetermined hip shape and a predetermined weight is caused to make a free fall onto a predetermined load position of the seat surface. Then, a damping waveform at a position as close as possible to the load center point of a pressure plate is determined with an accelerometer or displacement gauge. In this invention, the pressure plate used is of JM type and has a weight of 50 kg, as mentioned above.

For purposes herein, the term "JASO B 407" refers to the publication entitled "Test Code of Seating Comfort for Automobile Seats" published by the Society of Automobile Engineers of Japan, Inc., and "JM type" is defined as a pressure plate of specific configuration made according to the predetermined standard set forth in the aforementioned JASO B 407 publication. Each of these defined terms shall be construed according to the specified standards in effect at the time of filing of the application.

The damping waveform is detected as a damping waveform diagram as plotted in FIG. 9, for example. The logarithmic decrement is determined from the following Formula (1) by using the damping waveform diagram:

$$\lambda = \log_e 1/n(a_0/a_1 + a_1/a_2 + \ldots + a_{n-1}/a_n) \quad (1)$$

where $\lambda$: a logarithmic damping factor, a: an amplitude, and n: number of wave forms read from the diagram.

In the aforementioned seat cushion, on the other hand, a displacement difference from the maximum-downward displaced point in the free oscillation to a displacement point after the oscillation absorption is preferably 14.5 mm or more.

In the damping waveform diagram plotted in FIG. 9, more specifically, the displacement difference B between the maximum downward displacement point of the freely oscillating pressure plate to the displacement point in equilibrium after the oscillation absorption is set to 14.5 mm or more. Thereby, the stroke feel is improved.

In the aforementioned seat cushion, on the other hand, the rebound ratio at the free oscillation is preferably 58% or more so that a satisfactory rebound feel in the seat is achieved.

The rebound ratio means a ratio of first bouncing-up of the pressure plate after the free fall, that is, a ratio (C/A×100) of a first bouncing-up C to the initial displacement or the maximum displacement A, as shown in the damping waveform diagram in FIG. 9.

In the aforementioned seat cushion, moreover, a dynamic spring constant for a forced oscillation is preferably 2.68 kgf/mm or less. Thereby, a satisfactory stroke feel can be achieved when seating.

In the invention, the forced oscillation means an oscillation of the pressure plate of 50 kg in JM type at the time when a vertical oscillation of a full oscillation amplitude of 5 mm is applied to the seat cushion while the pressure plate is loaded at a predetermined load position of the seat surface, in the oscillation test prescribed in JASO B 407.

Here in the oscillation test of JASO B 407, the acceleration or absolute displacement of a pressure plate having a predetermined hip shape and a predetermined weight is measured with an accelerometer or displacement meter, by oscillating an oscillator table vertically at a predetermined amplitude in a changing frequency, with the seat cushion being fixed on the oscillator table, and with the pressure plate being loaded at a predetermined load position on the seat surface. The pressure plate used in the invention is of the JM type having a weight of 50 kg, as described above. Oscillation of the oscillator table has an amplitude of 5 mm.

From this measurement result, there is obtained a transmissibility characteristic diagram indicating a relation between oscillation frequency and a transmissibility, as plotted in FIG. 10. The transmissibility is a ratio of the acceleration of the pressure plate to the acceleration of the oscillator table when the acceleration is measured. When the absolute displacement is measured, the transmissibility is a ratio of the absolute displacement of the pressure plate to the full vertical amplitude of the oscillator table.

The dynamic spring constant is determined by the following Formula (2):

$$Kd=(2\pi f_0)^2 W/G \quad (2).$$

Here, Kd: a dynamic spring constant (kgf/mm), $f_0$: a resonance frequency (Hz), W: a load (kgf) by the pressure plate, and G: gravitational acceleration (9,800 mm/s$^2$). The resonance frequency $f_0$ is given as the frequency when the transmissibility indicates the maximum, from the transmissibility characteristic diagram plotted in FIG. 10. Here, the maximum of the transmissibility is called the "resonance magnification D".

DETAILED DESCRIPTION OF THE PREFERRED EMBODIMENT

A seat cushion according to one embodiment of the invention will be described with reference to FIGS. 1 to 8.

Figure 1:
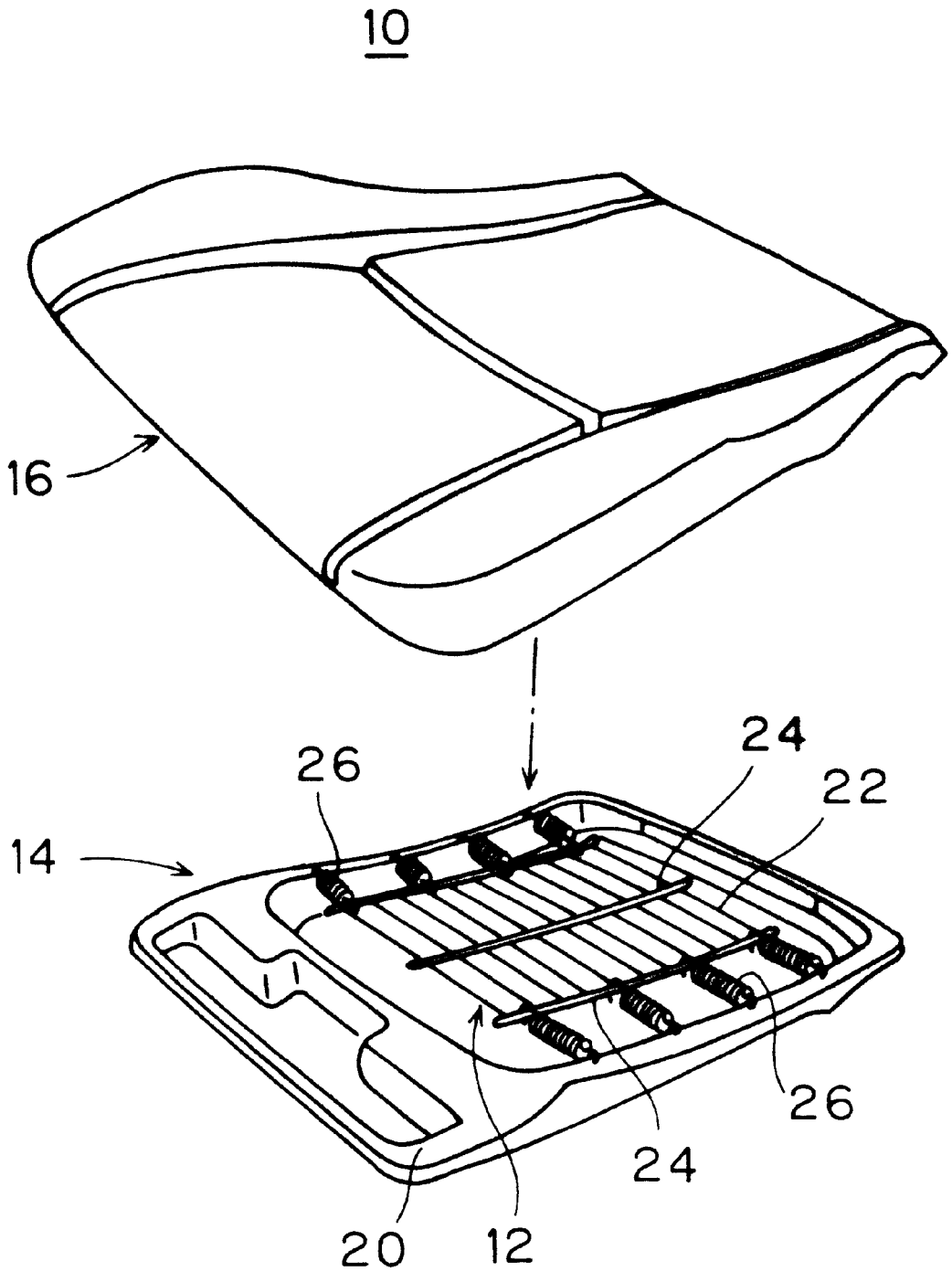
FIG. 1 is an exploded perspective view of a seat cushion according to one embodiment of the invention.

FIG. 1 is an exploded perspective view of a seat cushion 10 according to one embodiment of the invention. This seat cushion 10 is used for a front seat of a car.

As shown in FIG. 1, this seat cushion 10 is comprised of a seat frame 14 having a steel spring 12, and a cushion pad 16 of molded soft-polyurethane foam placed on the steel spring 12.

On the portion of the cushion pad 16 to contact with the steel spring 12, as shown in FIGS. 2 to 6, there is integrally formed a stretchable nonwoven fabric 18, in laminated manner. In this embodiment, more specifically, not only the portion of the cushion pad 16 to be contacted by the steel spring 12 but also substantially the entire area of the back face of the cushion pad 16 to be contacted by the entirety of the seat frame 14 including the steel spring 12 is covered with the stretchable nonwoven fabric 18.

In this embodiment, on the other hand, the stretchable nonwoven fabric 18 is molded integrally with the cushion pad 16 by bonding it to the back face of the cushion pad 16 at the time when this cushion pad 16 is foam-molded. In detail, the cushion pad 16 is removably fixed on the inner face of an upper mold of a foaming mold for foam-molding the cushion pad 16; a liquid-form material for the soft polyurethane foam is injected into lower mold for foam-molding; after the upper mold is closed, the injected liquid-form material for the foam is allowed to be foamed and cured; finally, the obtained foam is removed from the foaming mold. In this way, the stretchable nonwoven fabric 18 is integrally molded onto the cushion pad In advance of above-described integral molding, an adhesive film with a separable sheet may be pasted onto the face of the stretchable nonwoven fabric to contact with the liquid-form material for the foam, which separable sheet has a stretchability at least equal to that of the nonwoven fabric.

When the adhesive film is set on the inner-face of the upper mold, the separable sheet is removed before the foaming and curing of the liquid-form material. Meanwhile, the invention should not be limited to such integral molding, but the laminating integration can also be effected, for example, in following manner, after foam-molding of a cushion pad, the stretchable nonwoven fabric is pasted through a rubber-base adhesive onto the contacting portion of the cushion pad to be contact with the steel spring.

Figure 8:
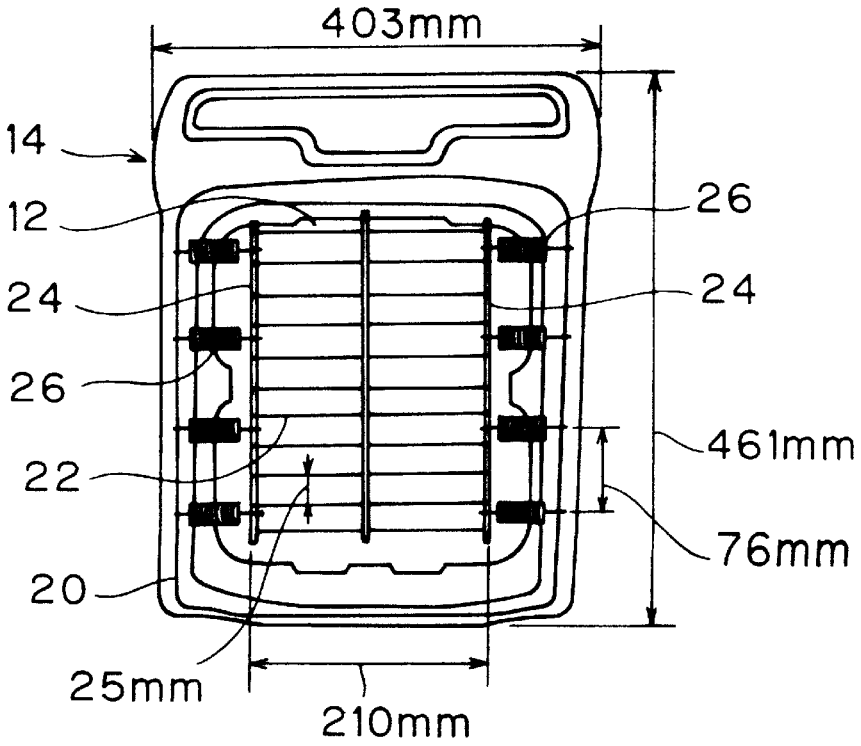
FIG. 8 is a top plan view of a frame in the same seat cushion.

The seat frame 14 is constructed, as shown in FIGS. 1 and 8, to include a frame member 20 made of a rigid body such as steel, and the steel spring 12 arranged inside of the frame member 20 for supporting the cushion pad 16 elastically. In this embodiment, the steel spring 12 is exemplified by a contour mat or a kind of sheet spring in which a number of thin steel wires 22 are arrayed in parallel. Specifically, the steel spring 12 is constructed to include numerous thin steel wires 22 arrayed in parallel at a predetermined interval in the longitudinal direction of the seat, three rods 24 arranged at the two right and left ends and at the center of the thin steel wires 22 and extending in the longitudinal direction for connecting the numerous steel wires 22, and a plurality of coil springs 26 for connecting the right and left rods 24 and the frame member 20. Here, the steel spring 12 should not be limited to such contour mat but can be exemplified by springs of various types such as PULLMAFLEX type or an S-shaped spring type.

According to the seat cushion 10 of this embodiment, the stretchable nonwoven fabric 18 is molded integrally with the contacting portion of the cushion pad 16 with the steel spring 12 so that the wear and breakage, as might otherwise be caused by the steel spring 12, of the cushion pad 16 are prevented. In response to a load applied by a human body of seated person, on the other hand, a free stretching which approximate the deformation of the steel spring 12 itself is attainable. As a result, a stroke feel is improved even though the cushion pad 16 has a density and a hardness equal to those of the prior art. In short, the seat cushion 10 sinks deeply but does not touch the bottom. Moreover, the rebound ratio rises to improve the rebounding feel. As a result, a moderate or comfortable rebounding feel is experienced when sitting on the seat cushion 10 by the hip or pushing it by the hand. In other words, a satisfactory seating comfort can be achieved with neither uncomfortable feeling nor nerves-jarring feeling.

The features of the invention will be described in more detail with reference to an Example and a Comparative example.

THE EXAMPLE

The seat cushion 10 according to the embodiment thus far described was fabricated as the seat cushion of Example.

Figure 7:
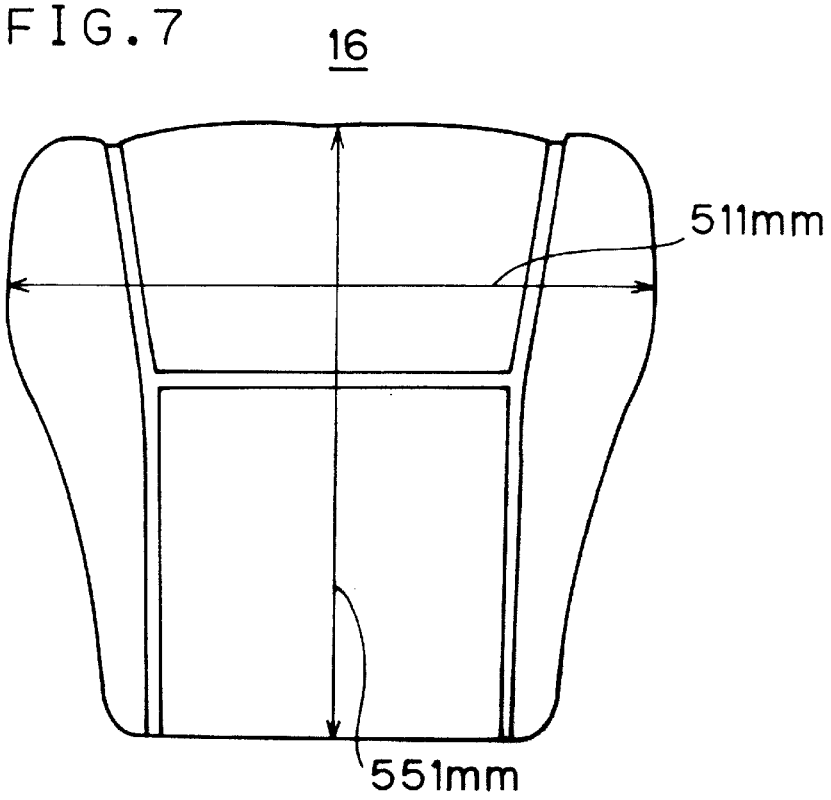
FIG. 7 is a top plan view of a cushion pad in the same seat cushion.

Here, the cushion pad 16 was given a length of 551 mm and the maximum width of 511 mm, as shown in FIG. 7, and its thickness and widths at four portions in the longitudinal direction of the seat were given the sizes written in FIGS. 3 to 6. on the other hand, the foam density (according to JIS (Japanese Industrial Standards) K 6401) of the cushion pad 16 was 0.050 g/cm$^3$, and the 25% hardness (JIS K 6401) was 21 kgf/200 ϕ.

The seat frame 14 was given, as shown in FIG. 8, the length of 461 mm, the maximum width of 403 mm, the distance of 210 mm between the right and left rods 24, the distance of 25 mm between the steel wires 22, and the interval of 76 mm of arrangement of the coil springs 26.

The stretchable nonwoven fabric 18 used was the spun bond nonwoven fabric (commercially available under the trade name of Espansione UHO100 of Kanebo Co., Ltd.) having a basis weight (gram-digitized mass per square meter of the fabric) of 100 g/m$^2$, a thickness of 0.37 mm, and 443% elongation after fracture according to JIS L 1096.

Figure 9:
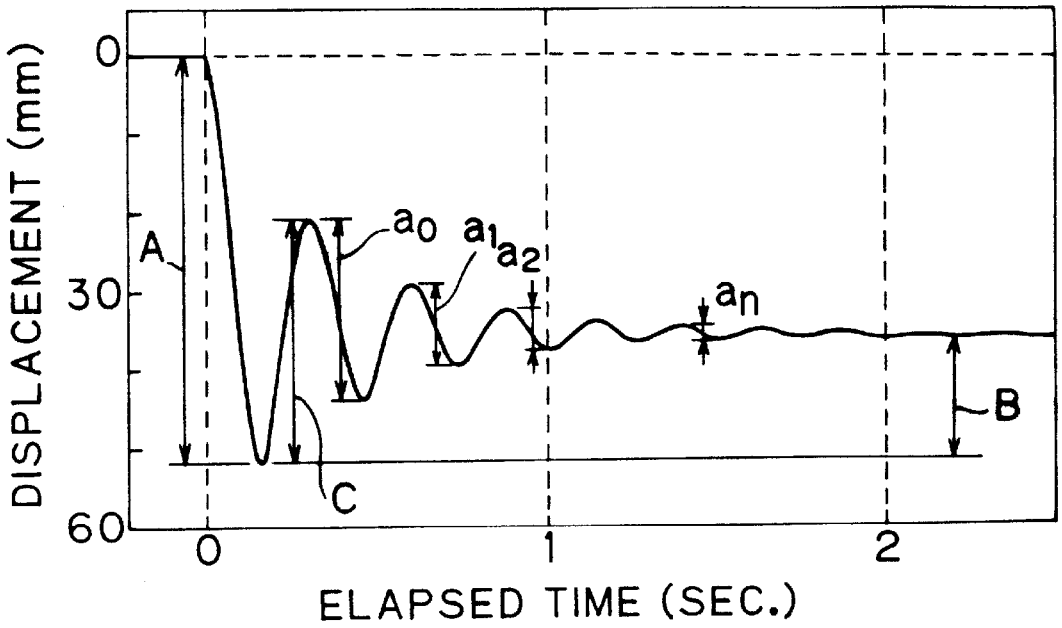
FIG. 9 is a damped waveform diagram of a free oscillation.

On the seat cushion of this Example, a pressure plate of 50 kg in JM type (i.e., JM50) was used to perform the damping test according to JASO B 407 to decide the damping waveform diagram of a free oscillation, as plotted in FIG. 9, to determine a rebound ratio (C/A×100), the maximum displacement A, the displacement difference B from the maximum displacement point to a displacement point after the oscillation absorption, a logarithmic decrement λ and a damping time. Here, the logarithmic decrement λ was calculated from the above-specified Formula (1). The damping time is a time period from $a_0$ to $a_n$ ($a_n \leqq a_0/10$) in FIG. 9.

Figure 10:
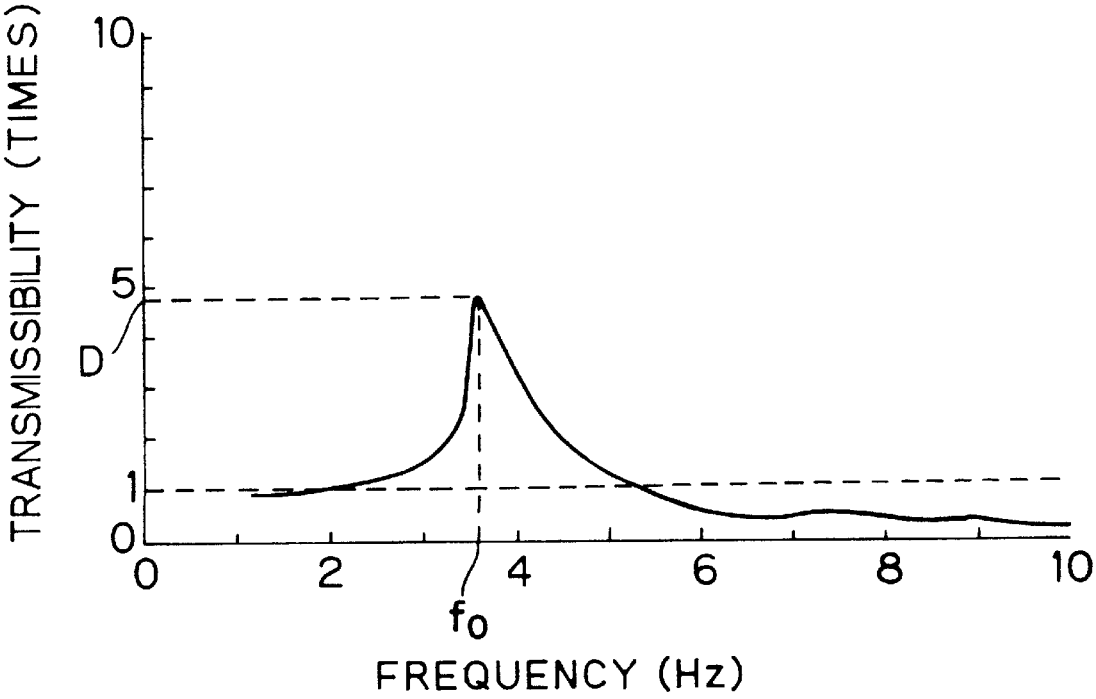
FIG. 10 is a transmissibility characteristic diagram of a forced oscillation.

On the other hand, the pressure plate of 50 kg in JM type (i.e., JM50) was used perform the damping test of JASO B 407 to decide the transmissibility characteristic diagram of a forced oscillation, as plotted in FIG. 10, to measure a resonance frequency $f_0$, a resonance magnification D, a 6 Hz transmissibility or a transmissibility at a frequency of 6 Hz, a 10 Hz transmissibility or a transmissibility at a frequency of 10 Hz, and a dynamic spring constant Kd. Here, the dynamic spring constant Kd was calculated from the above-specified Formula (2).

Figure 2:
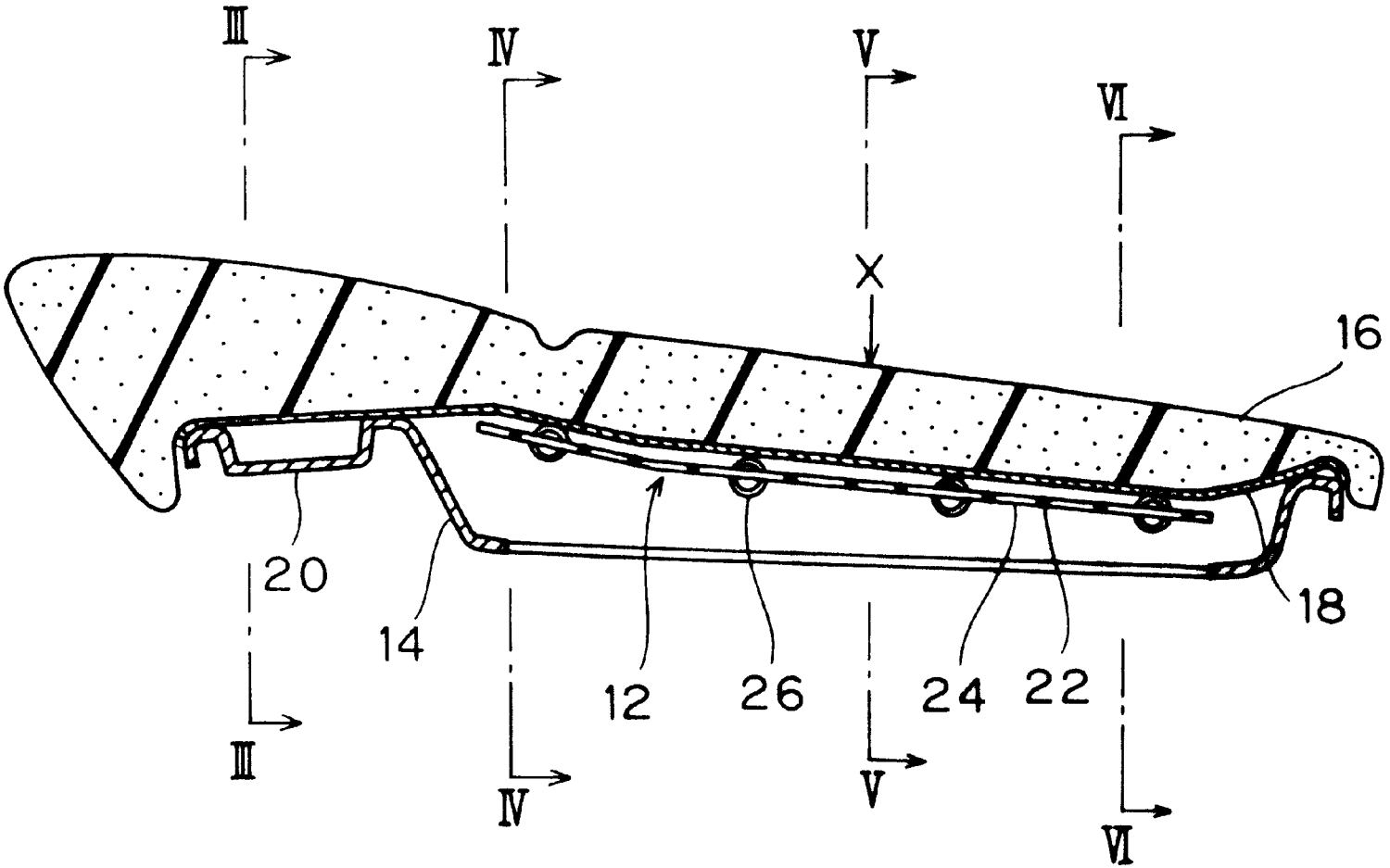
FIG. 2 is a section of the same seat cushion.
Figure 3:
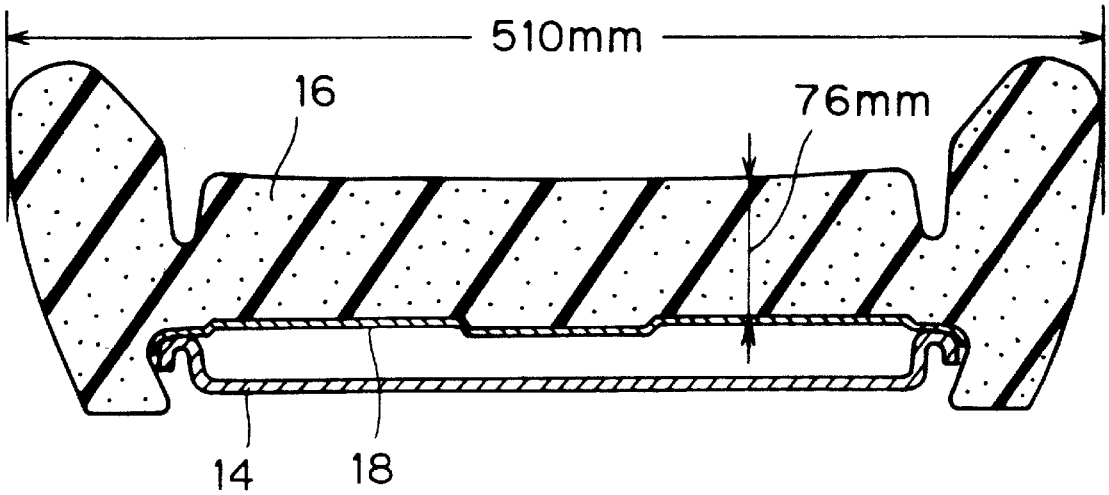
FIG. 3 is a section taken along line III—III of FIG. 2.
Figure 4:
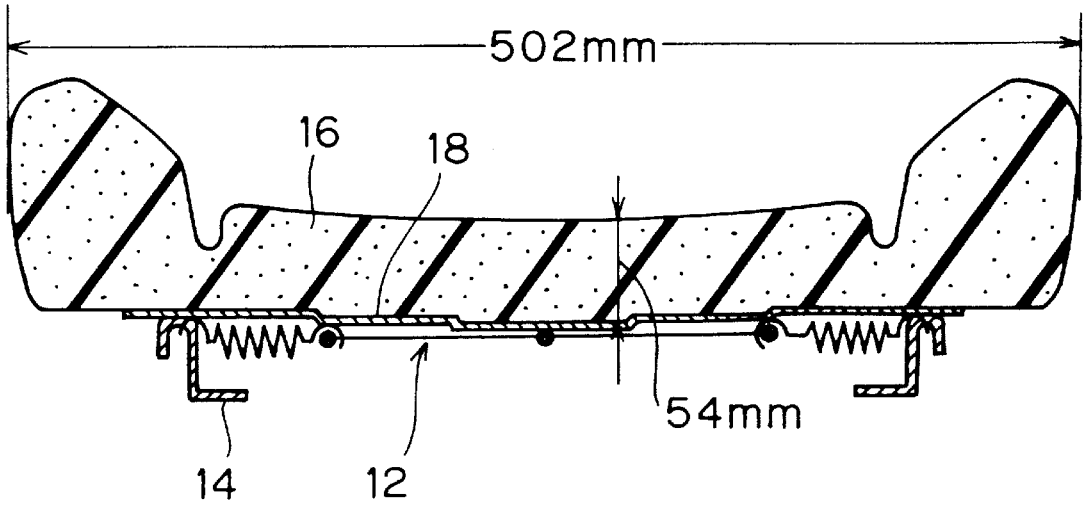
FIG. 4 is a section taken along line IV—IV of FIG. 2.
Figure 5:
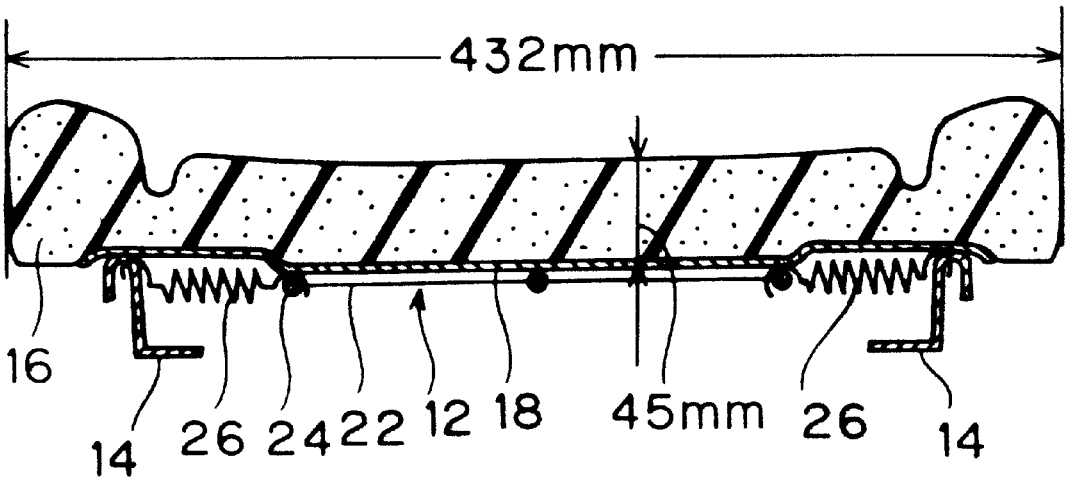
FIG. 5 is a section taken along line V—V of FIG. 2.
Figure 6:
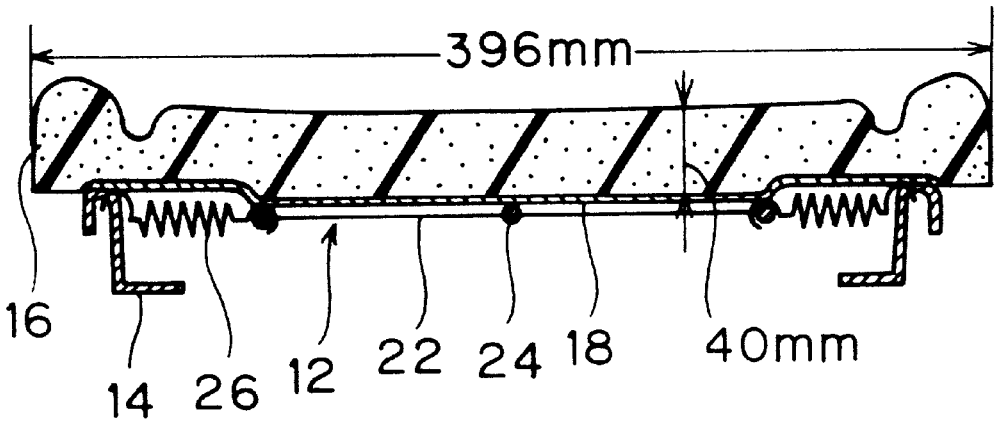
FIG. 6 is a section taken along line VI—VI of FIG. 2.

In the aforementioned damping test and oscillation test, the loading position of the pressure plate was located at point X in FIG. 2 so that the thickness of the cushion pad 16 at the loading position was 45 mm, as shown in FIG. 5. On the other hand, the aforementioned damping test and oscillation test were carried out three times respectively, and obtained values of each physical property were averaged.

Moreover, a car seat was prepared by using that seat cushion and was subjected to sensory tests on its seating comfort. These sensual tests were made on the "stroke feel" or such a feel that the seat sank deeply but did not touch the bottom when the hip is seated, and on the "rebound feel" or such a feel that the hip or hand rebounded moderately or comfortably. These sensory tests were carried out by each of twenty persons so as to give a grading in the following five rankings. Obtained gradings in numerical values were averaged:

1 . . . Inferior;

2 . . . Rather Inferior;

3 . . . Ordinary;

4 . . . Rather Excellent; and

5 . . . Excellent.

The results are enumerated in Table 1.

Comparative Example

The same seat cushion as that of the Example was made excepting that the stretchable nonwoven fabric was replaced by coarse blanket having the "basis weight" of 120 g/m$^2$ a thickness of 2.6 mm and an elongation after fracture of 30 to 90% or less according to JIS L 1096, and the physical properties and the sensory tests were performed on the cushioning properties of the seat as in Example. The results are enumerated in Table 1.

As seen from Table 1, the seat cushion of Example had a rebound ratio of 58% or more, a logarithmic decrement of 0.69 or less and a displacement difference B of 14.5 mm or more for the free oscillation, and a dynamic spring constant of 2.68 or less for the forced oscillation. As compared with the seat cushion of Comparative example using the coarse blanket, the stroke feel and the rebound feel were drastically improved to make a prominent difference in the seating comfortableness.

TABLE 1

| | | Example | Comparative example |
|---|---|---|---|
| Free Oscilation | Rebound Ratio (%) | 61.3 | 53.5 |
| | Maximum Displacement A (mm) | 48.7 | 48.2 |
| | Displacement Difference B (mm) | 15.3 | 13.3 |
| | Logarithmic Decriment | 0.642 | 0.743 |
| | Damping Time (secs.) | 0.940 | 0.761 |
| Forced Oscilation | Resonance Frequency (Hz) | 3.61 | 3.72 |
| | Resonance Magnification | 4.91 | 4.15 |
| | 6 Hz Transmissibility | 0.61 | 0.64 |
| | 10 Hz Transmissibility | 0.21 | 0.24 |
| | Dynamic Spring Constant (kgf/mm) | 2.62 | 2.79 |
| Sensory Evaluation | Stroke Feel | 4.6 | 2.6 |
| | Rebound Feel | 4.4 | 2.8 |

What is claimed is:

1. A seat, comprising:

a seat frame including a steel spring;

a cushion pad comprised of polyurethane foam placed on said steel spring;

a stretchable nonwoven fabric which is integrally formed in laminated manner onto a portion of said cushion pad, said cushion pad being in contact with said steel spring at said portion.

2. A seat according to claim 1, wherein a dynamic spring constant is no greater than 2.68 kgf/mm when a pressure plate of 50 kg in JM type is used and an entire amplitude at applying of oscillation is set at 5 mm, in a damping test of JASO B 407.

3. A seat according to claim 1, wherein a logarithmic decrement is no greater than 0.69 when a pressure plate of 50 kg in JM type has made a free fall, in a damping test of JASO B 407.

4. A seat according to claim 1, wherein a displacement difference form downward displacement point of a pressure plate of 50 kg in JM type to another displacement point after an oscillation absorption is at least 14.5 mm when said pressure plate is made to have a free fall in a damping test of JASO B 407.

5. A seat according to claim 1, wherein a rebound ratio is at least 58% when a pressure plate of 50 kg in JM type is made to have a free fall in a damping test of JASO B 407.

6. A seat, comprising:

a seat frame including a steel spring;

a cushion pad made of soft polyurethane molded foam placed on said steel spring;

a stretchable nonwoven fabric which is integrally formed in laminated manner onto a portion of said cushion pad, said cushion pad being in contact with said steel spring at said portion, said stretchable nonwoven fabric having an elongation after fracture of at least 180%.

7. A seat, comprising:

a seat frame including a spring; and a cushion including a body comprised of polyurethane foam, said cushion further including a stretchable nonwoven fabric integrally formed in laminated manner onto a surface area portion of the body of said cushion pad, said cushion pad being received atop said spring such that said stretchable nonwoven fabric is interposed between said spring and said surface area portion of the body covered by said stretchable nonwoven fabric.

8. A seat according to claim 7, wherein said stretchable nonwoven fabric has an elongation after fracture of at least 180%.

9. A seat according to claim 7, wherein said stretchable nonwoven fabric is comprised of elastic fibers of at least one of a polyurethane and a polystyrene thermoplastic elastomer.

10. A seat according to claim 9, wherein said elastic fibers are obtained by one of a spun bonding method and a melt blowing method.

11. A seat according to claim 7, wherein said stretchable nonwoven fabric is integrally molded with the body of said cushion.

12. A seat according to claim 7, wherein said stretchable nonwoven fabric is pasted to said body through a rubber-based adhesive.

13. A seat according to claim 7, wherein said surface area portion extends over only a portion of a contact area between said spring and said cushion.

14. A seat according to 7, wherein said surface area portion extends substantially over a contact area between said spring and said cushion.

* * * * *